United States Patent [19]

Nielsen

[11] 4,348,273

[45] Sep. 7, 1982

[54] TREATING CRACKING CATALYST FINES CONTAINING A PASSIVATING MATERIAL

[75] Inventor: Richard H. Nielsen, Bartlesville, Okla.

[73] Assignee: Phillips Petroleum Company, Bartlesville, Okla.

[21] Appl. No.: 163,004

[22] Filed: Jun. 25, 1980

[51] Int. Cl.[3] ..... C10G 11/18

[52] U.S. Cl. ..... 208/113; 208/52 CT; 208/120; 208/127; 208/152; 252/411 R; 405/128

[58] Field of Search ..... 208/113, 127, 120, 52 CT, 208/152; 405/128, 129; 252/411 R

[56] References Cited

U.S. PATENT DOCUMENTS

| | | | |
|---|---|---|---|
| 2,391,334 | 12/1945 | Nicholson | 208/152 |
| 2,437,352 | 3/1948 | Fragen | 208/152 |
| 2,631,968 | 3/1953 | Peery | 208/152 |
| 2,651,600 | 9/1953 | Taff et al. | 208/152 |
| 2,901,419 | 8/1959 | Brill | 208/119 |
| 3,674,706 | 7/1972 | Box et al. | 252/412 |
| 4,101,417 | 7/1978 | Mitchell et al. | 208/120 |
| 4,148,714 | 4/1979 | Nielsen et al. | 208/114 |
| 4,222,856 | 9/1980 | Hansel et al. | 208/120 |
| 4,238,367 | 12/1980 | Bertus et al. | 208/120 |
| 4,255,287 | 3/1981 | Bertus et al. | 208/120 |
| 4,268,188 | 5/1981 | McKay et al. | 405/128 |
| 4,276,149 | 6/1981 | Chester et al. | 208/120 |

*Primary Examiner*—Delbert E. Gantz
*Assistant Examiner*—G. E. Schmitkons

[57] ABSTRACT

In a hydrocarbon conversion operation employing a fluidized cracking catalyst wherein the cracking catalyst has been passivated to render contaminating metals thereon substantially inactive thus to avoid undesired reactions and wherein the used catalyst is regenerated and the regeneration step yields catalyst fines and a flue gas and the flue gas and fines are separated in at least two stages a first stage yielding coarse fines and a later stage yielding finer fines the step of treating finer fines to render metals thereon non-leachable or having substantially reduced leachability to render the finer fines usable as land fill which comprises treating the finer fines with a tin and/or indium and/or a compound of tin and/or a compound of indium.

7 Claims, 1 Drawing Figure

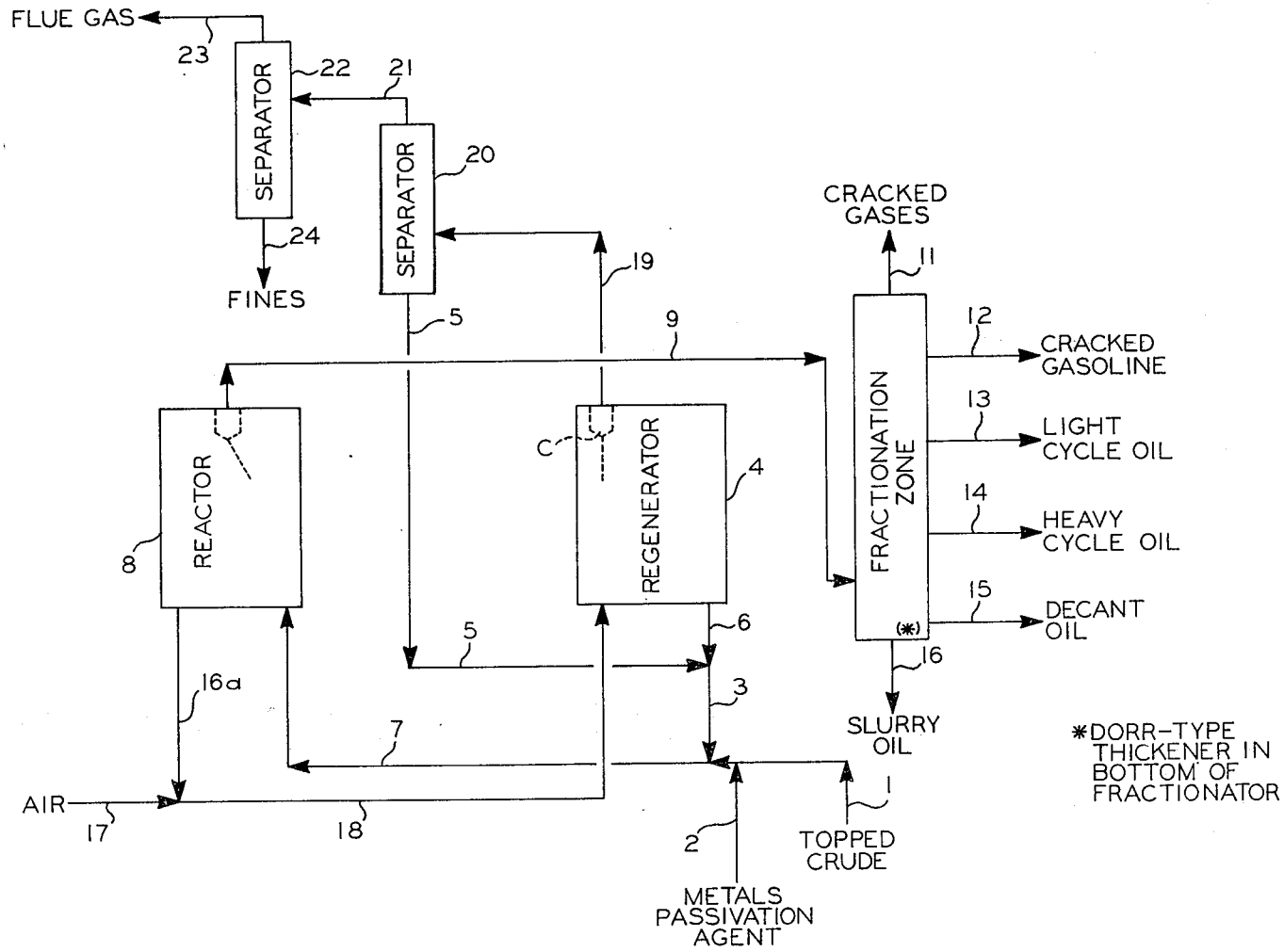
CRACKED GASOLINE
LIGHT CYCLE OIL
HEAVY CYCLE OIL
DECANT OIL
*DORR-TYPE THICKENER IN BOTTOM OF FRACTIONATOR
CRACKED GASES
FRACTIONATION ZONE
SLURRY OIL
TOPPED CRUDE
METALS PASSIVATION AGENT
REGENERATOR
SEPARATOR
SEPARATOR
FINES
FLUE GAS
REACTOR
AIR
1
2
3
4
5
6
7
8
9
11
12
13
14
15
16
16a
17
18
19
20
21
22
23
24
C

TREATING CRACKING CATALYST FINES CONTAINING A PASSIVATING MATERIAL

BRIEF SUMMARY OF THE INVENTION

In a mobile catalyst type catalytic cracking operation wherein the catalyst has been treated with a passivating agent, e.g., an antimony compound, to passivate contaminating metals, e.g., vanadium, iron, or nickel, thereon catalyst fines are recovered in at least two stages of separation from the flue gas emanating from the catalyst regenerator, the coarser fines, first recovered, being recycled to the process and the finer fines later or last recovered are treated as with tin and/or indium and/or their compounds to stabilize the passivating agent in the used catalyst against leaching by water and, therefore, to prevent leaching into ground water when the discarded catalyst is used as a land fill.

DETAILED DESCRIPTION

This invention relates to the disposal of a mobile cracking catalyst. In one of its aspects, it relates to the disposal of fines recovered from the flue gas of a fluidized catalytic cracking operation. In another of its aspects, the invention relates to the treatment of a hydrocarbon cracking catalyst which has been passivated with a passivated agent, e.g., an antimony compound, to stabilize the same against leaching of said compound therefrom by ground water thus to render it suitable for use as a land fill. In a more specific aspect still, the invention relates to the treatment of catalyst fines as may be recovered from a regeneration of a hydrocarbon cracking catalyst.

In one of the concepts, the invention provides a process for the treatment of fines recovered from the regeneration of a fluidized hydrocarbon cracking catalyst which has been passivated to stabilize the passivating agent thereon or therein against leaching by ground waters which comprises recovering fines from a regenerator flue gas in at least two stages, thus obtaining in a first stage coarse fines and in a later stage finer fines, recycling the first recovered fines to the regeneration operation and treating the later recovered fine with an agent to stabilize the passivating agent therein as further described herein. In another of its concepts, the invention provides a process as described wherein the passivating agent is stabilized by treating only the finer fines later or last recovered with tin and/or indium and/or one of their compounds.

I have discovered in the treatment to recover coarser fines and finer fines that on a weight percent basis the finer fines contained a considerably larger amount of passivating agents, e.g., antimony compounds, than do the coarser fines, as evidenced from the data given herein.

Ultimately, before disposal as land fill of the finer fine catalyst, which has been passivated, it can be treated to stabilize the passivating agent thereon against leaching by water such as ground water.

It is an object of this invention to recover and to treat a hydrocarbon oil cracking catalyst fines. It is another object of the invention to treat a hydrocarbon oil cracking catalyst fines recovered from the regeneration of a hydrocarbon oil cracking catalyst which has been used to catalytically crack a hydrocarbon oil and which has been passivated against the deleterious effect of contaminating metals thereon, to stabilize a passivating agent on said catalyst. It is a further object of the invention to stabilize passivating agents on catalyst fines obtained from the regeneration of a used hydrocarbon oil cracking catalyst.

Other aspects, concepts, objects, and the several advantages of the invention are apparent from a study of this disclosure, the drawing, and the appended claims.

According to the present invention, fines from a regenerator in which used hydrocarbon oil cracking catalyst is being regenerated, the catalyst having been passivated as with an antimony compound to negate the effect of contaminating metals on the catalyst, are processed in at least two stages to recover coarser fines which are recycled to the cracking operation, and finer fines, which are treated with a material to stabilize thereon or therein the passivating agent against leaching by ground waters.

In the drawing there is shown, diagrammatically, a catalytic cracking operation producing catalyst fines to which the invention is applicable.

Referring now to the drawing, topped crude and metals passivation additive are introduced by 1 and 2, respectively, along with added regenerated catalyst from 3 are passed by 7 into reactor 8 in which a fluidized catalytic cracking operation ensues. The conditions for the cracking operation, as well as for the later regeneration of catalyst operation, are well known in the art, do not form part of the invention here described, and, accordingly, are omitted for sake of brevity. They are, however, incorporated by this reference to them.

The topped crude upon suitable contact with the catalyst is passed by 9 to fractionation 10. Gases, gasoline, light cycle oil, heavy cycle oil, and decant oil are removed by way of 11, 12, 13, 14, and 15, respectively. A residual oil is withdrawn at 16.

Catalyst, which has been used in reactor 8, is withdrawn by 16*a*, admixed with air entering at 17, and passed by 18 into regenerator 4. For anyone skilled in the art in possession of this disclosure having studied the same, will understand that the catalyst is treated prior to its admixture with air to remove hydrocarbonaceous substances which may be unwanted at this juncture. In 4 the catalyst is regenerated largely by burning off coke or carbonaceous deposits thereon. Regenerated catalyst is taken by 6 and 3 into 7 for admixture with metals passivation additive and topped crude. As will be understood by one skilled in the art, the catalyst fines and gases passed through a cyclone C in the top of the regenerator. These are passed by 19 into a first stage separation at 20 from which coarser fines there recovered are returned to the process by 5. Finer fines and gases are passed from the top of 20 by 21 into second stage separation 22 from which flue gases are taken overhead at 23, finer fines being removed at 24. It is these finer fines which have been found to be richer in the passivating material than are the coarser fines. Yet, it is these finer fines which are undesirable to be retained in the catalyst cycle of the process. Separators 20 and 22 can be cyclone separator, cottrell precipitators, and the like.

Thus, it is these finer fines that are treated according to the invention to stabilize passivating metal therein so that the treated material can be used for land fill without the danger of the leaching of the passivating metal therefrom into ground waters.

The treatment which is applied, as earlier noted, involves the use of tin and/or indium and/or a compound of tin and/or a compound of indium.

Thus, there can be added water insoluble oxides and/or sulfides of tin and indium to the catalyst as in form of finely divided solids by dispersing or rolling the same or shaking, stirring, etc. Further, an aqueous or organic solution of a compound of tin and/or indium can be placed upon the used catalyst or fines. This can be followed by removal of solvent and then heating in air to a temperature at which the added compound is decomposed to leave a tin and/or indium in substantial proportion as an oxide or sulfide, or other inorganic composition thereof.

Suitable compounds of tin include stannous and stannic oxide and stannous and stannic sulfide. Suitable organic compounds are the tin salts of carboxylic acids such as stannous acetate, stannous butyrate, stannous octanoate, stannous oxalate, and stannous benzoate; tin thiocarboxylates such as stannous thioacetate and stannous dithioacetate; dihydrocarbyltin bis(hydrocarbyl mercaptoalkanoate) such as dibutyltin bis(isoctyl mercaptoacetate); tin thiocarbamates such as stannous propylthiocarbamate and stannous diethyldithiocarbamate; dihydrocarbyltin bis(0,0-dihydrocarbyl thiophosphate) such as dibutyltin bis(0,0-dipropyldithiophosphate); and the like.

Suitable compounds of indium include indium oxides and indium sulfides; also indium salts of the organic phosphates $[(RO)_2PXX]_3In$ where X is selected independently from the group oxygen and sulfur and R is an alkyl group containing from 2 to 20 carbon atoms such as ethyl, isopropyl, hexyl, decyl, and the like; indium tris(0,0-dihydrocarbyl phosphite) such as indium tris(0,0-dipropylphosphite), salts of organic acids such as indium tallate; and indium dialkyldithiocarbamates such as indium diethyldithiocarbamate.

Tin salts and indium salts of mineral acids, e.g., the halides, nitrates, sulfates, and the like are not considered to be suitable to treat metals-contaminated catalysts unless the acid released by hydrolysis of the salts is removed prior to discarding the catalyst. If not removed the acids will in the presence of water accelerate the rate of leaching of heavy metals from the treated catalyst.

Heavy metal contaminants usually found on FCC catalyst used to crack stocks containing the same that are treated by the process of this invention and thus made less leachable, are vanadium, chromium, iron, cobalt, copper, arsenic, antimony, platinum, and bismuth.

The concentration of tin and/or indium that is required to treat these heavy metals, considered as a group, can range from 1:100 to 100:1 on a weight basis. Routine testing will readily establish the optimum concentration for each application of the invention.

The Environmental Protection Agency (EPA) has provided a procedure to extract solid waste with water to determine whether toxic substances can enter ground water that is used as drinking water. This extraction procedure has been published in the *Federal Register*, Vol. 43, No. 243, pp. 58956–7 (Monday, Dec. 18, 1978). It differs only slightly from an earlier tentative EPA method that was used to obtain the data on which this invention is based. Other methods to test leachability of the catalyst treated by the process of the invention can be selected by one skilled in the art. It is necessary to ensure compliance with whatever law, local or other, which may be applicable to the presence of the contaminants and/or the substances used in the process of the invention.

Generally, the treatment of a catalyst or contact mass having thereon a metal resulting from its use as a petroleum conversion catalyst, said metal being leachable therefrom with water, which comprises treating the catalyst with at least tin, indium, a compound of tin, a compound of indium is described and claimed in copending Ser. No. 064,282, filed Aug. 6, 1979, (now U.S. Pat. No. 4,268,188) by Brent J. Bertus, Dwight L. McKay, and John S. Roberts. The disclosure of the copending application is incorporated by this reference to it.

The incorporation of the tin and/or indium and/or one of the compounds of these elements will be accomplished according to the disclosure of the said co-pending application.

The following information further illustrates the applicability of the present invention to the treatment herein described of the finer fines, prior to their disposal.

ILLUSTRATIVE EXAMPLE (Actual Sample Data)

| I. | Catalyst from Flue Gas 19 (100%): | |
|---|---|---|
| | Finer fines (24), wt. % | 8.9 |
| | Coarser fines (5), wt. % | 91.9 |
| | Finer Fines 24: | |
| | Wt. % Antimony, | 0.30 |
| | Coarser Fines 5: | |
| | Wt. % Antimony, | 0.16 |

On 100 pound basis of catalyst fines in stream 19, there are 8.9 pounds yielded (finer fines) as stream 24 containing 0.0267 pounds of antimony and 91.9 pounds yielded (coarser fields) as stream 5 containing 0.1458 pounds of antimony.

In making other runs, the following data were recorded.

| II. | Catalyst from Flue Gas (100%) | Run I | Run II |
|---|---|---|---|
| | Finer Fines, wt. %, | 69.5 | 32.4 |
| | Coarser Fines, wt. %, | 30.5 | 67.6 |
| | Finer Fines: | | |
| | Wt. % Antimony, | 0.33 | 0.41 |
| | Coarser Fines: | | |
| | Wt. % Antimony | 0.081 | 0.061 |

On 100 pound basis of catalyst fines, there are 69.5 pounds yielded (finer fines) containing 0.2294 pounds of antimony and 30.5 pounds yielded (coarser fines) containing 0.0247 pounds of antimony in Run I. In Run II, there are 32.4 pounds containing 0.1328 pounds of antimony and 67.6 pounds containing 0.0453 pounds of antimony.

In all runs, the coarse fines and finer fines had the nickel and vanadium about evenly distributed.

Reasonable variation and modification are possible within the scope of the foregoing disclosure, the drawing, and the appended claims to the invention the essence of which is that finer fines recovered in a stage, beyond first recovery of fines from a catalytic cracking catalyst regenerator, are treated to render passivating metals thereon non-leachable or less leachable by water so that such finer fines of catalysts can be disposed as land fill.

I claim:

1. A process comprising:

(a) cracking a hydrocarbon oil in a cracking zone in the presence of a cracking catalyst; wherein said catalyst becomes contaminated with a contaminant that is a member of the group consisting of vanadium, chromium, iron, cobalt, copper, arsenic, antimony, platinum, bismuth and compounds thereof;

(b) regenerating, in a regeneration zone, said cracking catalyst;

(c) passing from said regeneration zone gas and fines of said catalyst to a first separation zone.

(d) separating, in said first separation zone, coarser fines of said catalyst from finer fines of said catalyst; wherein said finer fines are contaminated with more, on a weight percent basis, of said contaminant than are said coarser fines;

(e) recycling said coarser fines to said cracking zone;

(f) separating, in a second separation zone, said gas from said finer fines; and (g) treating said finer fines with a stabilizing agent in an amount sufficient to improve the stability of said contaminant against leaching by water; wherein said stabilizing agent is a member of the group consisting of indium, tin and compounds thereof.

2. A process in accordance with claim 1 wherein said contaminant is a member of the group consisting of antimony and compounds thereof.

3. A process in accordance with claim 1 or 2 wherein said stabilizing agent is a member of the group consisting of a water insoluble oxide of indium and a water insoluble sulfide of indium.

4. A process in accordance with claim 16 or 17 wherein said stabilizing agent is an indium compound selected from the group consisting of indium oxide, indium sulfide, indium tris (0,0-dihydrocarbyl phosphite), indium tallate, indium dialkyldithiocarbamate and indium salt of the organic phosphate $$[(RO_2PXX]_3In;$$

wherein each X is selected independently from the group consisting of oxygen and sulfur; and wherein R is an alkyl group containing from 2 to 20 carbon atoms.

5. A process in accordance with claim 1 or 2 wherein said stabilizing agent is a member of the group consisting of a water insoluble oxide of tin and a water insoluble sulfide of tin.

6. A process in accordance with claim 1 or 2 wherein said stabilizing agent is a tin compound selected from the group consisting of stannous oxide, stannic oxide, stannous sulfide, stannic sulfide, a tin salt of a carboxylic acid, a tin thiocarboxylate, a dihydrocarbyltin bis(hydrocarbyl mercaptoalkanoate), a tin thiocarbamate and a dihydrocarbyltin bis(0,0-dihydrocarbyl thiophosphate).

7. A process in accordance with claim 1 or 2 wherein an aqueous solution of said stabilizing agent is used to treat said finer fines.

* * * * *

UNITED STATES PATENT AND TRADEMARK OFFICE

CERTIFICATE OF CORRECTION

PATENT NO. : 4,348,273

DATED : September 7, 1982

INVENTOR(S) : Richard H. Nielsen

It is certified that error appears in the above-identified patent and that said Letters Patent is hereby corrected as shown below:

Claim 4, column 6, line 3, after "claim" delete "16 or 17" and substitute therefor --- 1 or 2 ---.

Signed and Sealed this

First Day of March 1983

[SEAL]

*Attest:*

GERALD J. MOSSINGHOFF

*Attesting Officer*

*Commissioner of Patents and Trademarks*